United States Patent [19]

Major

[11] Patent Number: 4,972,617

[45] Date of Patent: Nov. 27, 1990

[54] AUTOMATIC FIREARM

[75] Inventor: William J. Major, Walnut Creek, Calif.

[73] Assignee: Barbara Major, Walnut Creek, Calif.

[21] Appl. No.: 439,727

[22] Filed: Nov. 20, 1989

Related U.S. Application Data

[60] Division of Ser. No. 265,603, Nov. 1, 1988, Pat. No. 4,889,032, which is a continuation of Ser. No. 876,331, Jun. 19, 1986, abandoned.

[51] Int. Cl.[5] ..... F41A 15/00

[52] U.S. Cl. ..... 42/25; 89/197

[58] Field of Search ..... 89/197, 194; 42/25

[56] References Cited

U.S. PATENT DOCUMENTS

| | | | |
|---|---|---|---|
| H,87 | 7/1986 | Reynolds | 42/25 |
| 1,144,285 | 6/1915 | Becker | 89/197 |
| 1,518,355 | 12/1924 | Reibel | 89/130 |
| 1,802,422 | 4/1931 | Heinemann | 89/129.01 |
| 1,851,696 | 3/1932 | Ekdahl | 89/197 |
| 2,049,776 | 4/1935 | Hyde | 89/129.01 |
| 2,109,578 | 3/1938 | Reising | 89/197 |
| 2,115,526 | 4/1938 | Holek | 89/129.01 |
| 2,376,057 | 5/1945 | Hyde | 89/197 |
| 2,389,095 | 11/1945 | Vesely | 89/129.01 |
| 2,447,091 | 8/1948 | Pope | 89/197 |
| 2,470,158 | 5/1949 | Gazda | 89/129.01 |
| 2,539,554 | 1/1951 | Sampson et al. | 42/69.02 |
| 2,632,391 | 3/1953 | Kintzinger | 89/194 |
| 3,788,191 | 1/1974 | Rose et al. | 89/155 |
| 4,028,993 | 6/1977 | Reynolds | 89/130 |
| 4,057,003 | 11/1977 | Atchisson | 89/138 |
| 4,344,351 | 8/1982 | McQueen | 89/129.02 |
| 4,355,563 | 10/1982 | Swieskowski | 89/130 |
| 4,649,800 | 3/1987 | Tessier | 89/194 |

FOREIGN PATENT DOCUMENTS

| | | | |
|---|---|---|---|
| 500564 | 8/1951 | Italy | 42/69.02 |
| 601517 | 5/1948 | United Kingdom | 89/197 |

*Primary Examiner*—David H. Brown

*Attorney, Agent, or Firm*—Townsend and Townsend

[57] ABSTRACT

An automatic firearm of especially simple construction and easy maintainability, having an adjustable cyclic firing rate. The firearm has a receiver with an upper and lower portion. The upper portion defines a cavity in which a bolt assembly reciprocates. The reciprocation is maintained by a single compression spring in the cavity, and the length of the cavity, and compression of the spring, are adjustable to vary the cyclic firing rate. The firearm includes an especially simple trigger group arrangement. The lower receiver portion is structured to protect the trigger group. Also disclosed is an especially simple, yet practical ejector mechanism.

1 Claim, 3 Drawing Sheets

AUTOMATIC FIREARM

This is a division of application Ser. No. 07/265,603, filed Nov. 1, 1988, now U.S. Pat. No. 4,889.032 which was a continuation of application Ser. No. 06/876 331, filed June 19, 1986, now abandoned.

BACKGROUND OF THE INVENTION

The invention relates to lightweight automatic portable firearms of the type generally known as submachine guns.

An automatic firearm fires continuously so long as the trigger of the weapon is depressed. Rounds of ammunition are automatically loaded into position to be fired, the rounds fired, and the fired cases ejected repeatedly at rapid rates. In a typical submachine gun these steps may be repeated so as to fire from 500 to 800 rounds per minute. If, as is common, the weapon takes a 9 mm parabellum cartridge, each round will produce 33,000–35,000 psi pressure within the weapon upon detonation. To be acceptable, a weapon design must be capable of repeating the above firing sequence reliably and safely at these high rates under the extremes of pressure and temperature.

Moreover, conditions of use in the field put further limitations on acceptable weapon designs. The weapon may be subjected to rough handling and inhospitable environmental conditions. The weapon must be designed so as to minimize the possibility of jamming or other malfunctions. And it should preferably be constructed so that it may be easily disassembled for cleaning and repairs in the field.

SUMMARY OF THE INVENTION

The present invention provides an automatic weapon which is at the same time of compact construction, simple to disassemble and reassemble in the field, has few moving parts, is comparatively inexpensive to manufacture, and is capable of adjustment to accommodate deterioration of ammunition occurring because of environmental conditions, extended storage, or the like.

The present automatic weapon is of the bolt action type and comprises a barrel assembly, receiver mechanism, bolt assembly reciprocating within the receiver mechanism in line with the bore of the barrel assembly, ammunition magazine, and trigger group. The receiver mechanism comprises an upper and lower receiver portion. The upper receiver portion defines a longitudinal cavity which carries the bolt assembly. The barrel assembly is demountably secured to the forward end of the upper receiver portion. For stability in firing, the ammunition magazine is vertically mounted to the forward end of the upper receiver portion behind the barrel assembly, and the lower receiver portion is extended along the length of the upper receiver portion to the magazine mounting. For added stability and protection the lower receiver portion is constructed as an integral unit enclosing the trigger group so as to expose only the trigger. Besides the trigger, the trigger group includes a sear for engaging the bolt assembly and a single linkage arm for coupling the sear to the trigger. The trigger, sear, and linkage arm are coupled in such a manner so as to eliminate any need for separate and distinct sear-cocking and sear-disconnect mechanisms. Reciprocation of the bolt assembly within the upper receiver portion is produced through a single compression spring disposed in the upper receiver portion behind the bolt assembly. Constructed in this manner, the weapon is capable of firing 9–mm rounds reliably at rates on the order of 500–800 rounds per minute, yet is of simpler construction and has fewer component parts than previously known to be possible.

Another aspect of the invention enables the weapon to be adjusted to account for variations in the detonation characteristics of different batches of ammunition. Such variations can occur, for example, due to deterioration over time, extremes of climatic conditions of storage or use, or differences in the manufacture of ammunition obtained from different sources. To account for such variations, an automatic weapon according to the invention may be provided with a means for adjusting the longitudinal dimension of the bolt-carrier cavity defined by the upper receiver portion. Such adjustment produces an associated adjustment in the compression of the spring under the reciprocating action of the bolt assembly. That is, adjusting the cavity length produces an adjustment in the cyclic firing rate of the weapon.

A further understanding and appreciation of the nature, operation, and advantages of the invention may be gained by reference to the following portions of the specification and attached drawings.

DETAILED DESCRIPTION OF A SPECIFIC EMBODIMENT

Figure 1:
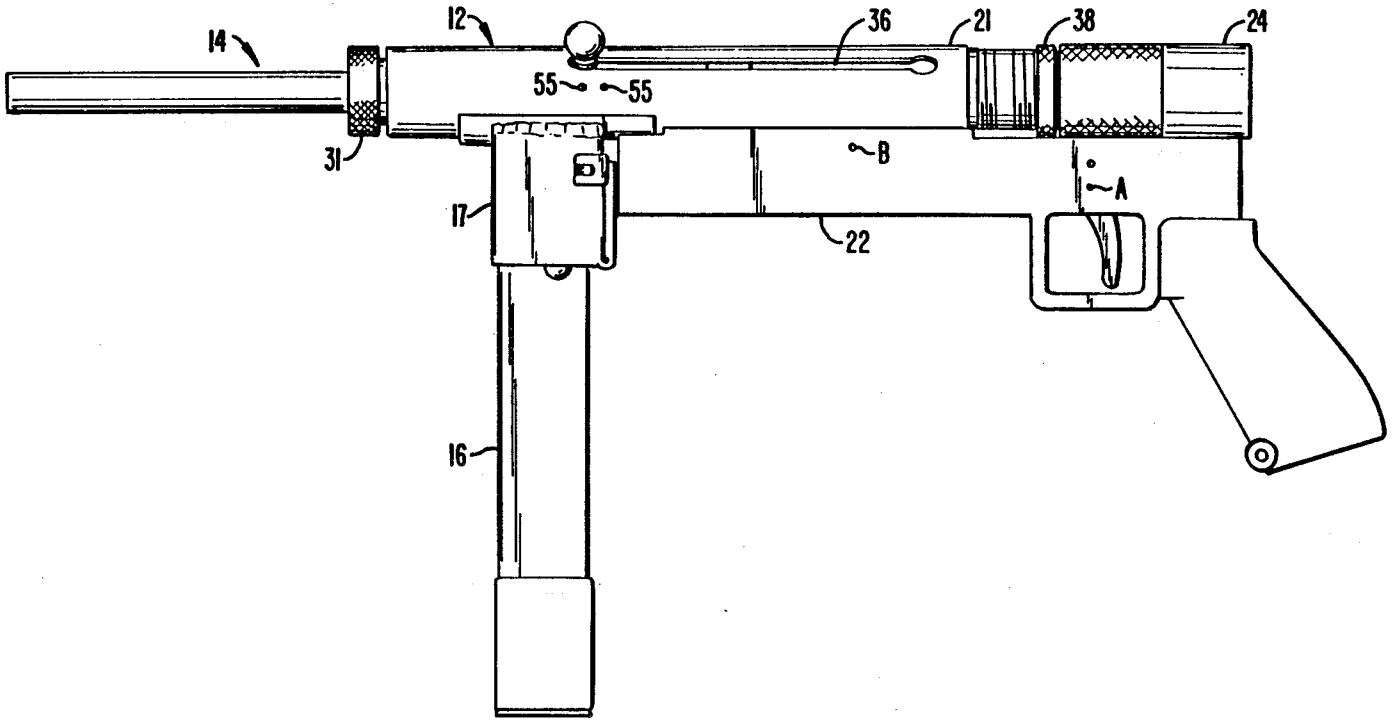
FIG. 1 is a side elevational view of an assembled weapon according to the invention.

FIG. 1 illustrates an overall view of a specific embodiment of a submachine gun according to the invention in its assembled configuration. The component parts and the manner in which the weapon is broken down may be seen in the exploded view of FIG. 2.

Figure 2:
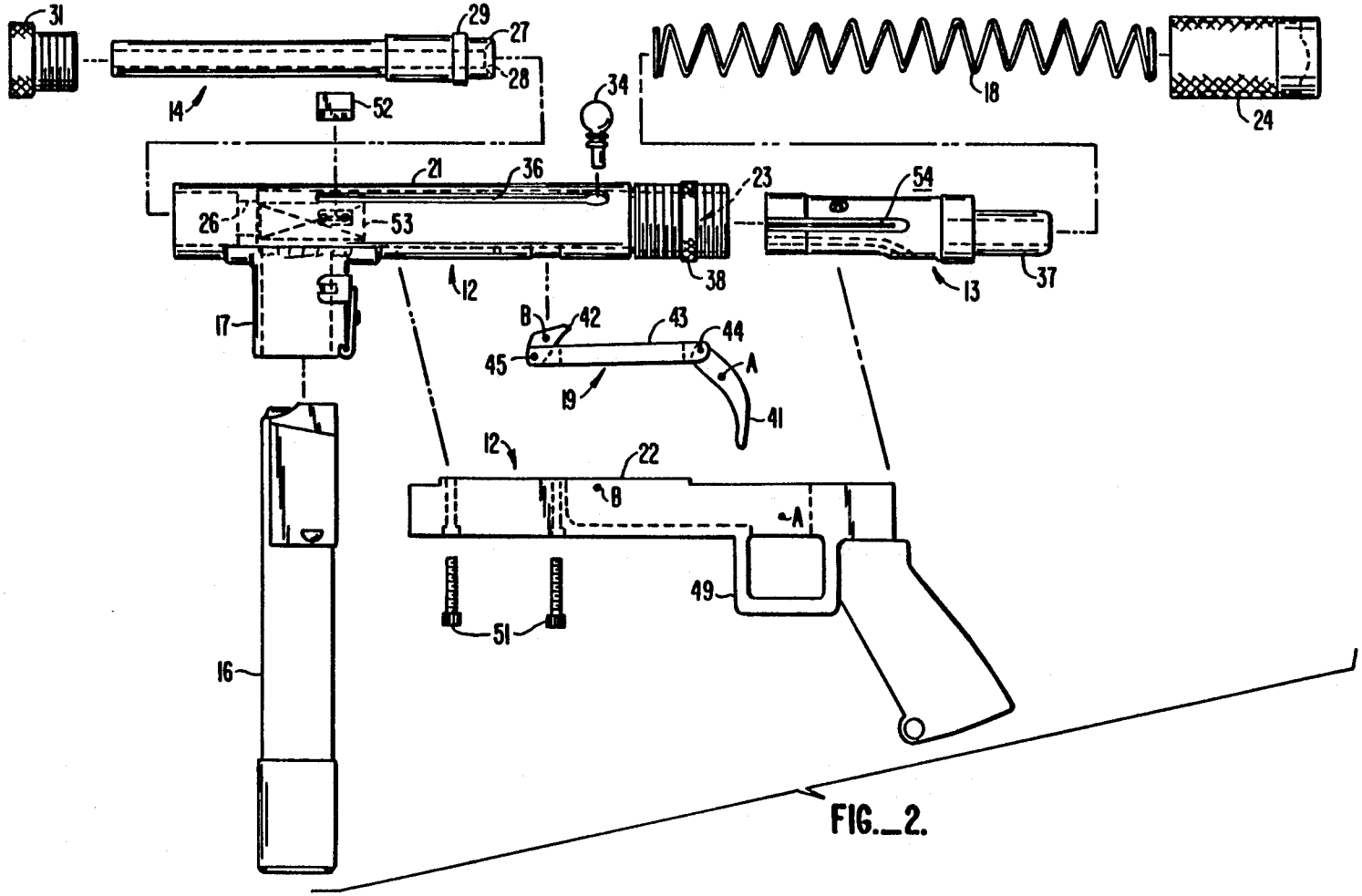
FIG. 2 is an exploded elevational view of the weapon of FIG. 1.

As seen in FIGS. 1 and 2, the weapon includes a receiver mechanism 12, a bolt assembly 13, a barrel assembly 14, an ammunition magazine 16, a means 17 for mounting the magazine 16 to the receiver mechanism 12, a compression spring 18, and a trigger group 19.

The receiver mechanism 12 comprises an upper receiver portion 21 and a lower receiver portion 22. The upper receiver portion defines an elongate cavity 23 extending longitudinally in line with the bore of the barrel assembly 14. For simplicity, for low manufacturing cost, and for structural integrity, the upper receiver portion 21 may be provided by a tubular member as illustrated in FIGS. 1 and 2.

The rear end of the tubular member is closed by a cap 24. For reasons explained below, the cap 24 is preferably formed with internal threads and the tubular member with external threads so that the cap may be screw-mounted onto the tubular member. Mounting the cap in this manner enables the length of the cavity 23 to be adjusted. In the embodiment of the invention actually constructed, the upper receiver portion was formed with a tubular member roughly 11.3 inch (28.7 cm)

long, 1.5 inch (3.8 cm) outside diameter, and wall thickness of roughly 0.125 inch (0.32 cm). The overall length of the tube and cap was roughly 14.25 inch (36.2 cm) with the cap in its fully extended position and 13.6 inch (34.4 cm) with the cap in its fully retracted position. Thus, in the embodiment actually constructed the cavity length could be varied by roughly 0.69 inches (1.75 cm).

Secured to the inner wall of the upper portion 21 in the vicinity of the forward end is a barrel alignment member 26. The alignment member 26 is in the form of a solid ring having a central bore, which receives the end of the barrel assembly 14 as it is mounted to the upper receiver portion 21. The end of the barrel assembly is formed with a wall 27 of enhanced thickness defining the firing chamber 28, which holds a cartridge as it is fired. The barrel assembly also includes a stop ring 29 for positioning the barrel assembly against the alignment ring. The central bore of the alignment ring 26 is sized to snugly receive the outer wall 27 of the firing chamber. The alignment ring 26 serves two purposes. First, it assists in aligning the barrel assembly 14 with the upper receiver portion 21 as the weapon is assembled. Second, it provides an additional substantial mass around the firing chamber for added safety and stability. The barrel assembly 14 is secured to the upper receiver portion 21 by a threaded barrel bushing 31. The interior wall of the upper receiver portion 21 is tapped to receive the bushing 31. The barrel bushing 31 has a central bore sized to snugly receive the enhanced thickness of the barrel wall in front of the stop ring 29.

The magazine 16 is of conventional construction. For example, it may be provided by the magazine conventionally used with the well known Sten gun. Unlike the Sten gun, in which the magazine is side-mounted, the magazine in the present weapon is preferably mounted in a vertical configuration. The magazine is mounted directly to the upper receiver portion 21 through a mounting means suitable for the particular magazine employed. The vertical configuration has been found to provide additional stability when firing the weapon.

The body of the bolt assembly 13 includes a conventional spring-loaded extractor 32, central firing pin, (see FIG. 4A) and cocking knob 34 extending through a longitudinal slot 36 in the upper receiver portion 21. The bolt assembly is formed with a tailpiece portion 37, which differs from conventional bolt assembly construction in that, for reasons noted below, the present tailpiece has been bored out to reduce the amount of mass which the tailpiece portion adds to the bolt assembly.

The bolt assembly 13 reciprocates back and forth in the cavity 23 to repeatedly fire the rounds of ammunition fed into the forward section of the upper receiver portion 21 by the magazine 16. All automatic bolt-action weapons include some sort of reciprocation means for sustaining the reciprocating motion of the bolt assembly. In the present invention the reciprocating motion is sustained by the single compression spring 18. The spring 18 is coiled with a diameter to slip over the tailpiece 37 of the bolt assembly so as to maintain alignment of the bolt assembly and compression spring during reciprocation. Alternatively, the bolt assembly may include a bored out section for receiving the coil spring interiorly instead of exteriorly as with the tailpiece.

An advantage of the present construction is that it allows the cyclic firing rate of the weapon to be adjusted easily in the field so as to optimize the firing rate for the ammunition at hand. The conditions under which ammunition primer compounds detonate are known to vary depending upon such factors as age, humidity, and other climatic parameters. The cyclic firing rate of the present invention can be adjusted to compensate for variations in these parameters and their effect on the ability of the ammunition to detonate. The cyclic firing rate is adjusted by adjusting the length of the cavity 23. Increasing the length of the cavity increases the travel of the bolt assembly 13, hence the cycle time of the bolt assembly. In this manner the cyclic firing rate is reduced.

In open-breech weapons it is conventional for the bolt assembly to block the breech to prevent gases from escaping and consequent loss of pressure until the bullet has left the barrel. To achieve this purpose, bolt assemblies are typically designed with a mass sufficiently greater than the bullet's mass that the bolt assembly's inertia maintains the bolt assembly in its breech-blocking position until the bullet passes from the barrel. It is advantageous in the present invention to maintain the mass of the bolt assembly at about the minimal level necessary to achieve the breech-blocking function. Increasing the bolt assembly inertia beyond that point detrimentally affects the cyclic motion under the influence of the compression spring 18. For this reason the tailpiece portion 37 has been hollowed out so as not to add excessive mass.

Continuous adjustment of the cyclic firing rate is most easily provided by means of the screw mounting of the cap 24 to the upper receiver portion 21. The upper receiver portion is also provided with a locking ring 38 for locking the cap 24 into position once the optimum firing rate has been determined. It has been found, for example, that with a spring measuring 10 inches in uncompressed length and having a spring constant of 1.78 pounds per inch (312 newtons per meter), the cyclic firing rate can readily be varied in the range of 550–800 rounds per minute. Although the embodiment of the invention illustrated herein provides a continuous adjustment of the cyclic rate, those skilled in the art will now readily appreciate that the cap 24 may be provided with discrete stops defining a discrete number of prescribed firing rates.

Figure 3:
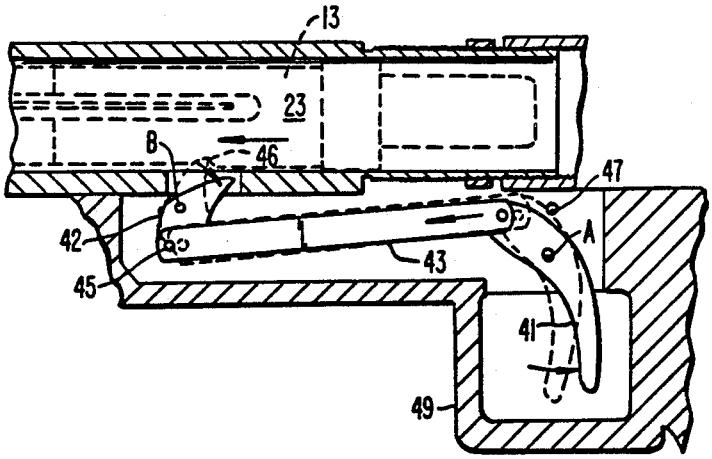
FIG. 3 is a cut-away view showing the trigger group, in which the cocked configuration is shown in phantom.

The trigger group 19 is illustrated in FIGS. 2 and 3. The trigger group comprises trigger 41, sear 42, and linking arm 43. The trigger and sear are mounted with pins to the lower receiver portion to pivot about the points A and B, respectively. The trigger and sear are each pivotally coupled to opposite ends of the linking arm 43 at the points 44 and 45. Directly linking the trigger to the sear in this manner provides for simpler construction, fewer moving parts to jam, and fewer surfaces to wear.

The configuration of the trigger group with the sear 42 in its cocked position and the trigger 41 in its forward position is illustrated in phantom in FIG. 3. With the trigger in its forward position the sear engages the bolt assembly 13 at the sear notch 46 and prevents the weapon from firing. The forward position of the trigger is defined by the stop pin 47. The trigger is held in its forward position under the action of the compression spring 18 urging the bolt assembly forward against the sear. Depressing the trigger drops the sear to the configuration shown in solid lines in FIG. 3 and allows the bolt assembly to reciprocate freely. So long as the trigger is depressed, the weapon will continue to fire. If finger pressure on the trigger is released, the natural vibration of the weapon will cause the sear to pivot upwards, in which configuration it will engage and stop the travel of the reciprocating bolt assembly. However, the upward movement of the sear into its engaging position can be assisted by manually urging the trigger forward with a slight pressure of the trigger finger. This can be avoided, of course, by incorporating into the trigger group a trigger return spring as found in known weapon systems; however, this adds one more component to malfunction and is not necessary for operation of the weapon.

Figure 4A:
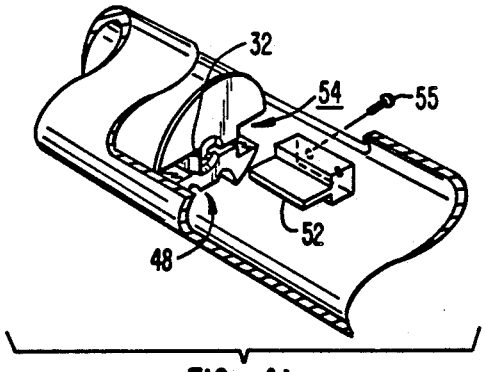
FIG. 4A is a cut-away perspective view showing the ejector arrangement.
Figure 4B:
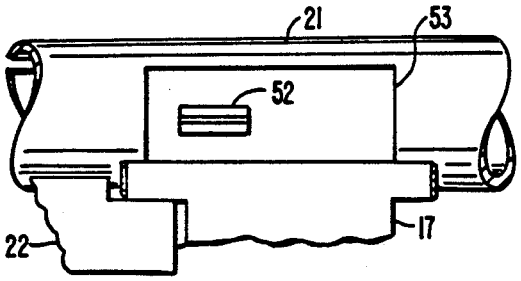
FIG. 4B is an elevational view of the ejector and ejection port.

With the above construction only the sear-to-bolt-assembly contact is subjected to any appreciable wear. The mass of the sear has been enhanced to help absorb the impact load applied to it by the bolt assembly and thereby provide enhanced wear resistance. For this purpose the sear is preferably formed with a dimension about one-half inch in the direction transverse to the bolt motion. As seen in FIG. 4A the width of the groove 48 in the bolt assembly is larger than in conventional bolt construction to accommodate the extra-wide sear of the present weapon.

In automatic weapons intended to be broken down in the field, the trigger group is typically protected by a dust cover of lightweight construction, which can be easily removed to provide access to the trigger group. In the present invention protection for the trigger group is provided by the lower receiver portion 22, which is formed as a single integral unit housing the trigger group and exposing only the trigger, which is protected by a trigger guard 49 integral with the lower receiver portion. The lower receiver portion is detachable from the upper receiver portion to provide access to the trigger group for cleaning and repairs For added weight and stability in firing the weapon, the lower receiver portion extends beyond the trigger group along the bottom of the upper receiver portion to the magazine mount 17. The lower and upper receiver portions are secured to one another by bolts 51 with heads countersunk into the lower receiver portion, which screw into tapped holes in the bottom wall of the upper receiver portion.

After a cartridge is fired, the fired case is pulled from the chamber by extractor 32. The structure and operation of the extractor is conventional and hence will not be described further here. The fired case is discarded by ejector 52, which "kicks" the case from the breech of the weapon through ejection port 53 as the bolt assembly moves rearwards. See FIGS. 4A and B.

The ejection port in the present firearm is enlarged over that typically found in automatic weapons so as to aid in positive, safe ejection of the spent cases from the weapon under rapid-fire conditions. In the preferred construction the longitudinal dimension of the ejection port is at least three times the length of a case to be ejected.

The ejector 52 is formed with a T-shaped cross section. The base of the "T" provides a secure mounting to the interior wall of the upper receiver portion opposite the ejection port 53. The stem of the "T" impacts against the back of the shell held by the extractor 32 to knock the shell free of the extractor and through the ejection port. The bolt assembly 13 is provided with a corresponding T-shaped groove 54 so that the ejector will not interfere with the reciprocating motion.

While the simple T-shape has been found to provide positive ejection, the stem of the T is subject to wear. To counteract the tendency of the ejector to wear, the ejector should be formed of a low-carbon steel or other equally hard material. The ejector 52 is detachably mounted to the inner wall of the upper receiver portion by screws 55. This enables a faulty or worn ejector to be replaced easily in the field. The ejector 52 is also formed with an extended length in the longitudinal direction of the cavity 23. With this shape, when the leading edge of the ejector is worn, the ejector can simply be reversed so that the opposite edge ejects the fired cases. Mounted with screws 55, the ejector can easily be reversed in the field. In this manner an ejector will last twice as long before it need be replaced.

In summary, the invention provides a weapon, in which the component subassemblies are reduced to the minimal construction capable of yielding an operational weapon. A weapon according to the invention is especially easy to maintain even under extreme conditions of use in the field: For the firing sequence it employs only five moving parts—the trigger 41, the sear 42, the linkage arm 43, the bolt assembly 13, and the extractor 32—and only two springs—the compression spring 18 and the extractor biasing spring. Any other movable parts are less critical and are restricted to the magazine 16 or the magazine release mechanism of the mounting means 17. In addition to and notwithstanding the simplicity of construction the cyclic firing rate can be simply adjusted to account for variations in the detonation characteristics of different batches of ammunition.

While the above provides a full and complete disclosure of the preferred embodiments of the present invention, various modifications, alternate constructions, and equivalents will occur to those skilled in the art given the benefit of this disclosure. Thus, the invention is not limited to the specific embodiment described herein, but is defined by the appended claims.

What is claimed is:

1. In a bolt action automatic firearm including a receiver mechanism defining a longitudinally extending cavity, a bolt assembly disposed within said cavity for reciprocation along the longitudinal direction thereof, and reciprocation means for maintaining the reciprocation of said bolt assembly in said cavity for firing ammunition disposed at the front end of said cavity at a cyclic firing rate, the improvement comprising an ejector for ejecting fired cases from the firearm, and a means for demountably securing the ejector in fixed disposition against an interior wall of said receiver mechanism, wherein:

said ejector-securing means is accessible from the exterior of said receiver mechanism for demounting said ejector;

said ejector has first and second edges, each said edge being formed for ejecting the fired cases from the firearm; and said ejector and said ejector-securing means are formed so that said ejector is mountable in two dispositions against an interior wall of said receiver mechanism in position to eject said fired cases, whereby said ejector can be mounted to present said first edge for ejecting said fired cases and can be re-mounted to present said second edge for ejecting said fired cases.

* * * * *